US005206880A

United States Patent [19]

Olsson

[11] Patent Number: 5,206,880

[45] Date of Patent: Apr. 27, 1993

[54] FURNACE HAVING TUBES FOR CRACKING HYDROCARBONS

[75] Inventor: Jan-Olof Olsson, Hallstahammar, Sweden

[73] Assignee: Kanthal AB, Hallstahammar, Sweden

[21] Appl. No.: 699,160

[22] Filed: May 13, 1991

[30] Foreign Application Priority Data

May 14, 1990 [SE] Sweden ..... 9001728

[51] Int. Cl.[5] ..... F27D 7/06

[52] U.S. Cl. ..... 373/111; 373/75; 373/109; 373/138; 148/242; 208/48 R; 208/106; 219/10.75; 219/6.5; 428/460

[58] Field of Search ..... 148/242, 3, 126.1; 75/228, 123 B; 419/6, 3, 47; 428/641, 648, 653; 208/106, 48 R, 113, 120, 122, 132; 423/244, 345, 349, 439, 453, 458; 502/65, 73, 302, 303, 304; 48/197 A; 373/111, 75, 109, 138; 219/10.75, 6.5

[56] References Cited

U.S. PATENT DOCUMENTS

| | | | |
|---|---|---|---|
| 2,062,358 | 12/1936 | Frolich | 423/458 |
| 2,436,282 | 2/1948 | Bennett | 423/450 |
| 2,769,772 | 11/1956 | Gomory | 208/130 |
| 3,463,865 | 8/1969 | Sarraf | 373/75 |
| 3,536,776 | 10/1970 | Lo | 585/636 |
| 3,645,701 | 2/1972 | Banchik et al. | 208/48 R |
| 3,827,967 | 8/1974 | Nap et al. | 208/48 R |
| 4,439,236 | 3/1984 | Ray | 75/123 B |
| 4,576,653 | 3/1986 | Ray | 148/3 |
| 4,794,049 | 12/1988 | Takahashi et al. | 428/460 |
| 4,798,769 | 1/1989 | Hayashi et al. | 428/460 |
| 4,940,828 | 7/1990 | Petterson et al. | 585/652 |
| 4,999,089 | 3/1991 | Nakase et al. | 196/110 |

*Primary Examiner*—Bruce A. Reynolds
*Assistant Examiner*—Tu Hoang
*Attorney, Agent, or Firm*—Cohen, Pontani, Lieberman, Pavane

[57] ABSTRACT

A furnace for cracking of hydrocarbons, comprising one or several tubes through which the hydrocarbons flow during intensive heating and subsequent cracking. The starting material for the process can be e.g. naphtha or propane, mixed with a small amount of steam. When gases flow through the tube or tubes in the furnace, its temperature is increased up to about 850° C. In order to achieve this, the temperature in the furnace compartment is 1100°-1200° C., and the temperature of the gases in the tubes in the furnace can then exceed 1100° C. The tubes are made from an alloy comprising 15-30 weight % chromium, 3-10 weight % aluminum, the remainder of the composition being mainly iron. This alloy allows significant extension of the possible duration of operation without exchange of the tubes. A further improvement can be achieved by the formation on the inner walls of the tubes of a layer of aluminum oxide, obtained by oxidation of the tubes before the furnace is first used. The tubes are preferably seamless, and formed by extrusion of powder metallurgical billets.

6 Claims, 1 Drawing Sheet

FURNACE HAVING TUBES FOR CRACKING HYDROCARBONS

FIELD OF THE INVENTION

The present invention relates to a furnace for cracking of hydrocarbons. Such a furnace has one or mostly several tubes, through which the hydrocarbons flow during intensive heating and cracking. Furnaces according to the present invention have tubes which make possible longer operational times between exchange of tubes and higher working temperature in the furnace than is possible by prior art furnace designs.

BACKGROUND ART

Prior art furnaces for cracking of hydrocarbons have tubes made from nickle base alloys with a relatively high chromium content. This composition brings with it several disadvantages, including that the tube material is expensive and does not have a fully satisfying resistance to carburization and formation of carbides, primarily chromium carbide. Further the shape durability (dimensional stability) of these tubes which are designated as being formed of a high temperature material, is not fully sufficient in some applications.

A cracker is used for the cracking of hydrocarbons. The starting material can be e.g. naphtha or propane mixed with a smaller amount of steam. When the gases are passed through the tubes in the cracking furnace, its temperature is increased up to about 850° C. Among important products which are obtained are ethylene and propene. Further hydrogen, methane, butene and other hydrocarbons are obtained. In order to avoid unwanted reactions, it is essential that the heating be very rapid and that the products which are obtained are thereafter rapidly cooled. The residence time in the furnace is only a few tenth of a second. The temperature in the furnace is 1100°-1200° C. and the temperature of the gases in the tubes in the furnace can be more than 1100° C. Heating of the furnace can be performed by burning gases from the cracking process, e.g. hydrogen and methane and a furnace may be equipped with a great number of burners, which can be positioned in the bottom and sides of the furnace.

The tubes which are used in the furnace should have the ability to withstand the high temperatures with a good shape durability or dimensional stability. They must also be resistant against oxidation and corrosion in order to tolerate the atmosphere present in the furnace. The carbon potential inside the tubes in the furnace is very high and the tube material should therefore be resistant against carburization and formation of carbides. Small amounts of sulphur are often added to the starting materials and the tubes must thus also be resistant to sulphur and sulphur compounds. On the inside of the tubes, deposits of carbon and coke form which may cause local temperature variations. These deposits may be removed suitably by oxidation thereof with steam.

SUMMARY OF THE INVENTION

The present invention is directed to a furnace having tubes formed of a material which has considerably improved resistance against the conditions present in the furnace. A furnace according to the invention has the characteristics that the tubes are made from an alloy having 15-30 weight percent Cr, 3-10 weight percent Al, the balance mainly being iron and up to 1% of one or more of yttrium, zirconium, titanium, hafnium, cerium and calcium, and may also include the normally present impurities and optionally small amounts of other alloying components that do not adversely affect the essential properties of the alloy, for the present application in furnace tubes. Preferably, the insides of the tubes are covered with Al oxide layers, preferably obtained by pre-oxidation of the tubes before the furnace is taken into operation. Preferred alloys for the tubes comprise 15-30 weight percent Cr, 3-10 weight percent Al and a total of not more than 1 weight percent of one or more of zirconium, titanium, hafnium, cerium and calcium. The tubes are preferably produced as seamless tubes by extrusion, and more preferably by extrusion of powder metallurgical billets. The heating of the hydrocarbon stirring the cracking process is preferably performed by direct current flow in the walls of the tubes. In this connection, the inside walls of the tubes are preferably provided with protrusions in order to enlarge the heating surface thereof.

A furnace according to the present invention has tubes made from an alloy having 15-30 weight % chromium, 3-10 weight % aluminium, and the balance being mainly or primarily iron. The alloy also comprises the usual impurities and possible smaller amounts of other alloying components. When these tubes are exposed to oxidizing conditions at high temperature, aluminium oxide is formed on the surface, and the inside of the tubes should have a layer of aluminium oxide before the furnace is used in production. In spite of the very high carbon potential inside the tubes during the cracking process, it has been shown that such tubes have a very good resistance to carburization and formation of carbides such as chromium carbide. The tubes also have excellent resistance against sulphur and sulphur compounds which are added to the hydrocarbons, in small amounts, in order to prevent carburization of the tube material. A furnace according to the present invention also has such properties that the addition of sulphur can be made unnecessary.

Suitably the tubes are in many cases made from an alloy which also includes up to 1 weight % of one or more of yttrium, zirconium, titanium, hafnium, cerium and calcium. Such additives have been found to improve the properties of the aluminium oxide layer. It has also been shown that, among others, the shape durability of tubes formed of the present alloys is very good when seemless tubes, produced preferably by an extrusion process, are used. For this purpose it is suitable to use billets made by powder metallurgical methods. Such tubes have high heat resistance to extremely high temperatures. The temperatures of the gases within the tubes may, with acceptable shape durability of the tubes, be up to about 1300° C., which is considerably higher than what has hereto been possible in this kind of furnace.

The materials which are used for the tubes of a furnace according to the present invention have, compared to prior art materials, a high electrical resistance. It is therefore possible to perform the heating wholly or partly by passing electrical current directly through the tubes.

The heat transfer from the walls of the tubes to the gas inside the tubes is mainly by radiation. As mentioned above, it is essential that the heating be very rapid, and it may therefore be advantageous to enlarge the radiating internal surface of the tubes by making the inner walls with projections having the shape of longitudinal bars or ribs. When the tube is formed by extrusion, this shape can be directly obtained by the corresponding shape of the extrusion dies.

BRIEF DESCRIPTION OF THE DRAWING

The invention will be described with respect to the figures shown in the accompanying drawings, in which.

DETAILED DESCRIPTION OF THE DRAWINGS

Figure 1:
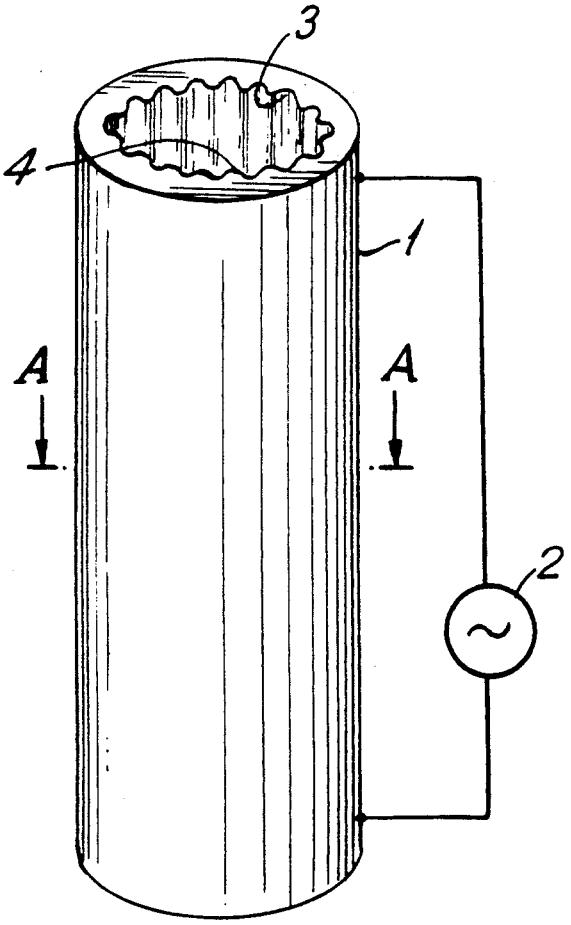
FIG. 1 shows schematically in perspective a furnace tube.

FIG. 1 shows schematically a furnace tube 1 having an inner surface 3, and which has an electrical heating apparatus 2. The inner surface 3 is covered with a layer of aluminum oxide, which is created in a pretreatment step by heating at an appropriate temperature in an oxidizing atmosphere.

Figure 2:
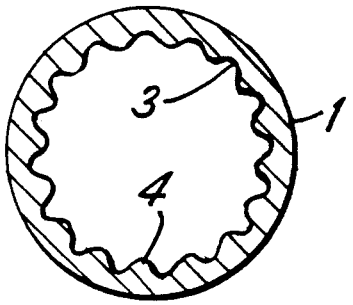
FIG. 2 shows schematically a cross section of the furnace tube of FIG. 1 along line A—A.

FIG. 2 shows schematically along line A—A of FIG. 1, a cross section of a preferred embodiment of the furnace tube 1 present invention having longitudinal ribs 4, enhanced in the drawing.

I claim:

1. A furnace for cracking hydrocarbons comprising: at least one seamless tube, having a wall, through which said hydrocarbons flow during intensive heating and cracking, said tube being made from an alloy having 15–30 weight percent Cr, 3–10 weight percent Al, the balance being primarily iron.

2. The furnace according to claim 1, wherein said tube has an inner surface covered by aluminum oxide layers obtained by preoxidation of said tube prior to operating said furnace.

3. The furnace according to claim 1, wherein said alloy comprises 15–30 weight percent Cr, 3–10 weight percent Al and a total of not more than 1 weight percent each of elements selected from the group consisting of yttrium, zirconium, titanium, hafnium, cerium and calcium.

4. The furnace according to claim 1, wherein said wall comprises an inner surface and a longitudinal axis, the inner surface having a plurality of ribs extending parallel to the longitudinal axis.

5. A furnace for cracking hydrocarbons comprising at least one seamless tube through which said hydrocarbons flow during intensive heating and cracking, said tube being made from an alloy comprising primarily iron, 15–20 wt. % Cr, and 3–10 wt. % Al, said alloy forming an aluminum oxide layer when exposed to oxidizing conditions at high temperature.

6. The furnace according to claim 5, wherein said aluminum oxide layer is obtained by pre-oxidation of said tube prior to operating said furnace.

* * * * *